US011744379B1

(12) United States Patent
Patel

(10) Patent No.: US 11,744,379 B1
(45) Date of Patent: Sep. 5, 2023

(54) BED FRAME ASSEMBLY AND METHOD FOR SUPPORTING A MATTRESS

(71) Applicant: ATMIYA GLOBAL HOSPITALITY LLC, West Columbia, SC (US)

(72) Inventor: Dipak Patel, West Columbia, SC (US)

(73) Assignee: ATMIYA GLOBAL HOSPITALITY, LLC, West Columbia, SC (US)

( * ) Notice: Subject to any disclaimer, the term of this patent is extended or adjusted under 35 U.S.C. 154(b) by 0 days.

(21) Appl. No.: 17/884,787

(22) Filed: Aug. 10, 2022

Related U.S. Application Data

(63) Continuation of application No. 17/112,238, filed on Dec. 4, 2020, now abandoned.

(60) Provisional application No. 62/944,528, filed on Dec. 6, 2019.

(51) Int. Cl.
*A47C 19/02* (2006.01)
*A47C 19/04* (2006.01)

(52) U.S. Cl.
CPC ..... *A47C 19/025* (2013.01); *A47C 19/04* (2013.01)

(58) Field of Classification Search
CPC ..... A47C 19/04; A47C 19/025; A47C 19/045; A47C 19/028; A47C 19/027; A47C 19/02; A47C 17/32; A47D 7/01; A47D 9/012; A61G 13/129
See application file for complete search history.

(56) References Cited

U.S. PATENT DOCUMENTS

| | | | | | |
|---|---|---|---|---|---|
| 672,863 | A * | 4/1901 | Sorey | A47C 19/04 | 5/202 |
| 1,101,288 | A * | 6/1914 | Kepko | A47C 17/32 | 5/8 |
| 1,699,498 | A * | 1/1929 | Hanauer | A47C 23/00 | 5/738 |
| 3,157,889 | A * | 11/1964 | Chanko | A47C 19/028 | 5/722 |
| 4,186,452 | A | 2/1980 | Underwood | | |
| 4,402,097 | A * | 9/1983 | Scott | A47D 9/012 | 5/200.1 |
| 4,648,141 | A * | 3/1987 | Mansouris | A47C 17/32 | 5/8 |
| D292,759 | S | 11/1987 | Pell | | |
| 5,758,372 | A | 6/1998 | Lopez | | |
| 6,708,941 | B1 | 3/2004 | Bowen | | |
| D616,666 | S | 6/2010 | Rizzardo | | |

(Continued)

FOREIGN PATENT DOCUMENTS

CN 203563958 U * 4/2014

*Primary Examiner* — David R Hare
*Assistant Examiner* — Alison N Labarge
(74) *Attorney, Agent, or Firm* — Schwartz Law Firm, P.C.

(57) ABSTRACT

A convertible bed frame assembly is configured to support a mattress. The bed frame assembly incorporates first and second side-by-side rectangular bed platforms. Each bed platform has a horizontal support surface, opposing lateral ends, and opposing interior and exterior longitudinal sides. A removable center extension is configured to reside between the interior longitudinal sides of the side-by-side bed platforms and coplanar with respective horizontal support surfaces. When installed, the center extension functions to separate the side-by-side bed platforms thereby increasing the width of the bed frame assembly. When removed, the side-by-side bed platforms combine together to reduce the width of the bed frame assembly.

10 Claims, 7 Drawing Sheets

(56) References Cited

U.S. PATENT DOCUMENTS

| | | | | |
|---|---|---|---|---|
| D653,047 | S | 1/2012 | Tekulve | |
| D661,122 | S | 6/2012 | Kubiak | |
| 8,196,310 | B2 | 6/2012 | Mcmahon et al. | |
| 9,314,386 | B1 | 4/2016 | Boyd | |
| 10,285,506 | B2 | 5/2019 | Choi | |
| 10,989,240 | B2 | 4/2021 | Self | |
| 2009/0100597 | A1 | 4/2009 | Oh | |
| 2009/0193583 | A1 | 8/2009 | Lee | |
| 2012/0222216 | A1 | 9/2012 | Jin | |
| 2015/0320225 | A1 | 11/2015 | Boyd | |
| 2016/0157622 | A1 | 6/2016 | Oh | |
| 2017/0172306 | A1 | 6/2017 | Serure | |
| 2017/0215598 | A1 | 8/2017 | Choi | |
| 2018/0110339 | A1 | 4/2018 | Moon | |
| 2018/0332973 | A1 | 11/2018 | Choi | |
| 2019/0029435 | A1 | 1/2019 | Choi | |
| 2019/0200776 | A1* | 7/2019 | Somers | A47D 9/00 |
| 2020/0205576 | A1 | 7/2020 | Choi | |

* cited by examiner

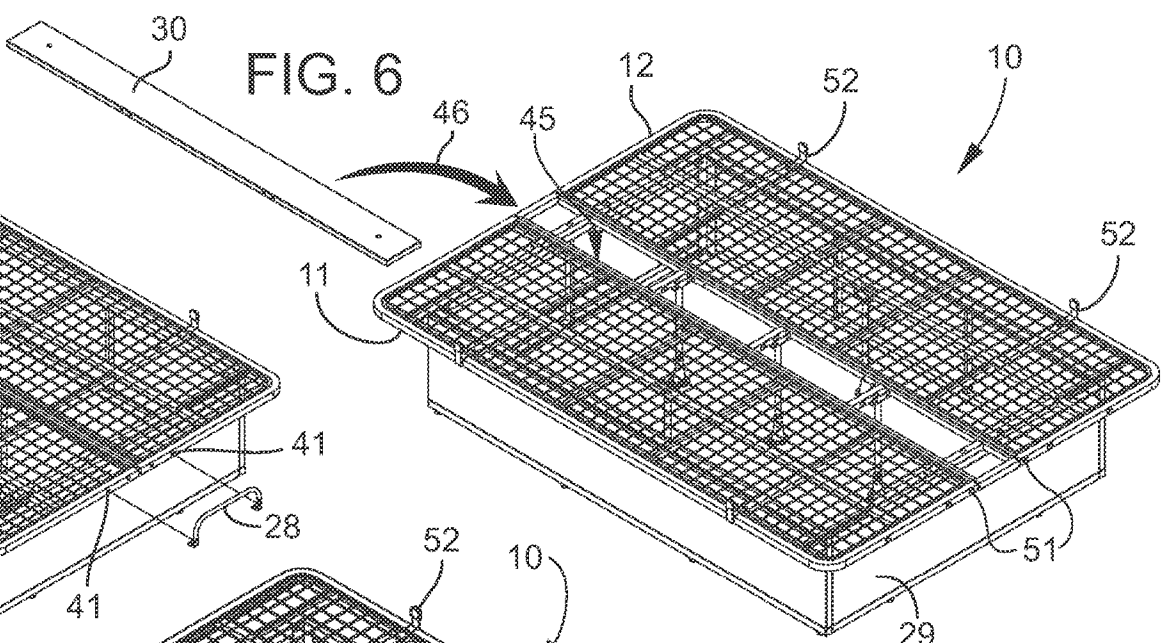
FIG. 6
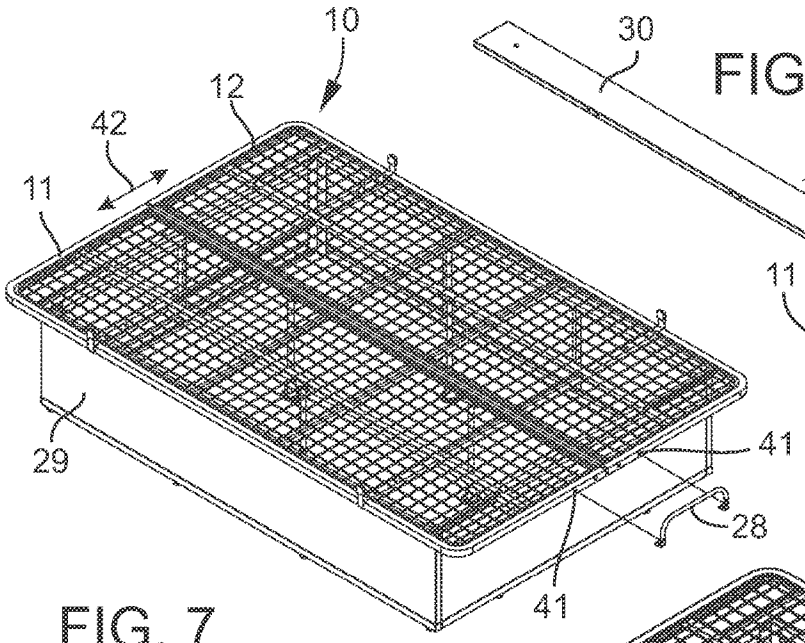
FIG. 7
FIG. 8
FIG. 9

BED FRAME ASSEMBLY AND METHOD FOR SUPPORTING A MATTRESS

TECHNICAL FIELD AND BACKGROUND OF THE DISCLOSURE

The present disclosure relates broadly and generally to a bed frame assembly and method for supporting a mattress. In exemplary embodiments, the invention of the present disclosure merges technology, safety and comfort in a convertible 16" metal bed frame assembly with particular application in the hospitality industry. Hotels and other like establishments require bed frames that ensure their guests get a sound, good-quality sleep but at a reasonable cost to the hotelier. The present bed frame assembly offers such a solution while overcoming certain deficiencies of the prior art; namely, challenges relating to assembly, handling and maintenance.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

According to one exemplary embodiment, the present disclosure comprises a convertible bed frame assembly configured to support a mattress and having a width and a length. The bed frame assembly incorporates first and second side-by-side rectangular bed platforms. Each bed platform has a horizontal support surface, opposing lateral ends, and opposing interior and exterior longitudinal sides. The horizontal support surfaces of the side-by-side bed platforms reside in substantially the same plane. A removable center extension is configured to reside between the interior longitudinal sides of the side-by-side bed platforms and coplanar with respective horizontal support surfaces. When installed, the center extension functions to separate the side-by-side bed platforms thereby increasing the width of the bed frame assembly. When removed, the side-by-side bed platforms combine together to reduce the width of the bed frame assembly.

According to another exemplary embodiment, the center extension comprises a solid continuous-surface panel removably fastened to the interior longitudinal sides of the side-by-side bed platforms and having opposing longitudinal sides and opposing lateral ends.

According to another exemplary embodiment, the opposing longitudinal sides of the center extension reside directly adjacent the interior longitudinal sides of the side-by-side bed platforms.

According to another exemplary embodiment, the opposing lateral ends of the center extension substantially align with respective lateral ends of the side-by-side bed platforms.

According to another exemplary embodiment, the horizontal support surface of each bed platform comprises a metal wire mesh.

According to another exemplary embodiment, a perimeter frame surrounds the metal wire mesh of each bed platform.

According to another exemplary embodiment, the perimeter frame comprises a square metal pipe.

According to another exemplary embodiment, a plurality of vertical support legs are located beneath each bed platform.

According to another exemplary embodiment, each bed platform comprises a plurality of underside strength-reinforcing lateral and longitudinal crossbars.

According to another exemplary embodiment, a plurality of extendable width adjustment bars are carried by respective lateral crossbars of each bed platform, and are configured to selectively adjust in a width direction of the bed frame assembly.

According to another exemplary embodiment, a mattress arrester is located at one end of the bed frame assembly.

According to another exemplary embodiment, the mattress arrester is attached to each of the side-by-side bed platforms.

According to another exemplary embodiment, the side-by-side bed platforms are substantially identical.

In another exemplary embodiment, the present disclosure comprises a bed frame assembly configured to support a mattress and having a width and a length. The bed frame assembly incorporates at least one rectangular bed platform having a horizontal support surface, opposing lateral ends and opposing longitudinal sides. The horizontal support surface includes a metal wire mesh. A perimeter frame surrounds the metal wire mesh of the bed platform. A protective marginal cover is located adjacent the perimeter frame and extends inwardly over wire ends of the metal wire mesh.

According to another exemplary embodiment, the protective marginal (solid surface) cover extends continuously along an entire width and length of the bed frame assembly.

According to another exemplary embodiment, the protective marginal cover extends inwardly over wire ends of the metal wire mesh a distance of approximately 1-3 inches.

In yet another exemplary embodiment, the present disclosure comprises a method for selectively adjusting a width dimension of a convertible bed frame assembly.

In yet another exemplary embodiment, the present disclosure comprises a method for protecting a mattress located on a metal wire platform of a bed frame assembly.

BRIEF DESCRIPTION OF THE DRAWINGS

Exemplary embodiments of the present disclosure will hereinafter be described in conjunction with the following drawing figures, wherein like numerals denote like elements, and wherein:

FIGS. 7, 8 and 9 are sequential views demonstrating installation of the center extension panel and conversion of the exemplary bed frame assembly from a reduced width dimension (e.g., for a full XL size mattress) to a wider dimension (e.g., for a queen size mattress);

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
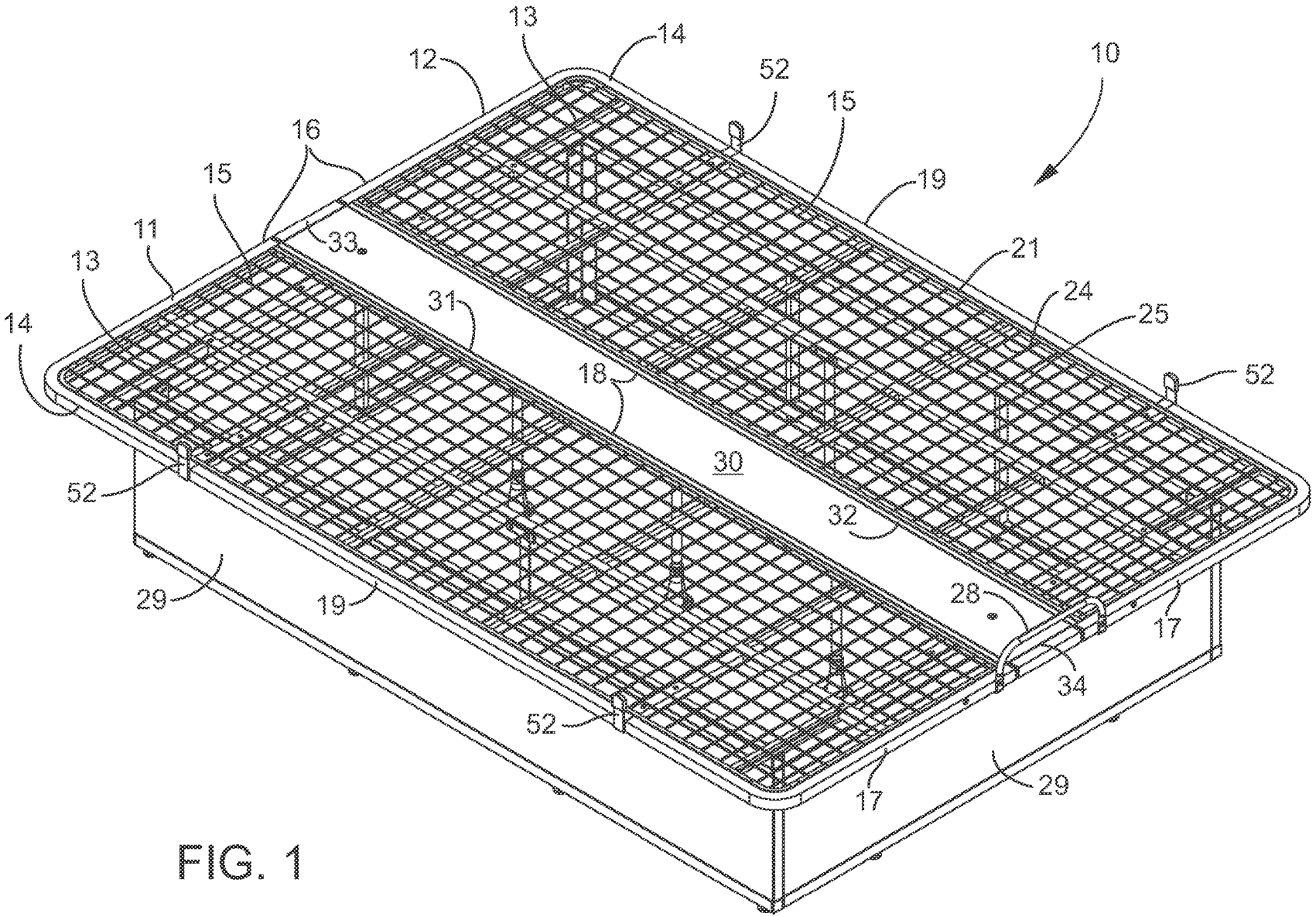
FIG. 1 is a perspective view of the present bed frame assembly according to one exemplary embodiment of the disclosure.

Referring now specifically to the drawings, a convertible metal bed frame assembly according to one embodiment of the present disclosure is illustrated in FIG. 1 and shown generally at broad reference numeral 10. The exemplary bed frame assembly 10 is configured to support a conventional rectangular mattress (not show) and incorporates identical side-by-side raised metal wire platforms 11, 12 which combine to form a strong and stable foundation for the mattress. In exemplary embodiments, the present bed frame assembly 10 provides even weight distribution across each raised platform 11, 12 and does not require use of a traditional boxspring beneath the mattress. All components of the exemplary bed frame assembly 10 described further herein are fabricated of metal, and are assembled together using standard hardware (e.g., nuts, bolts, rivets, screws) and other suitable attachment means.

Figure 2:
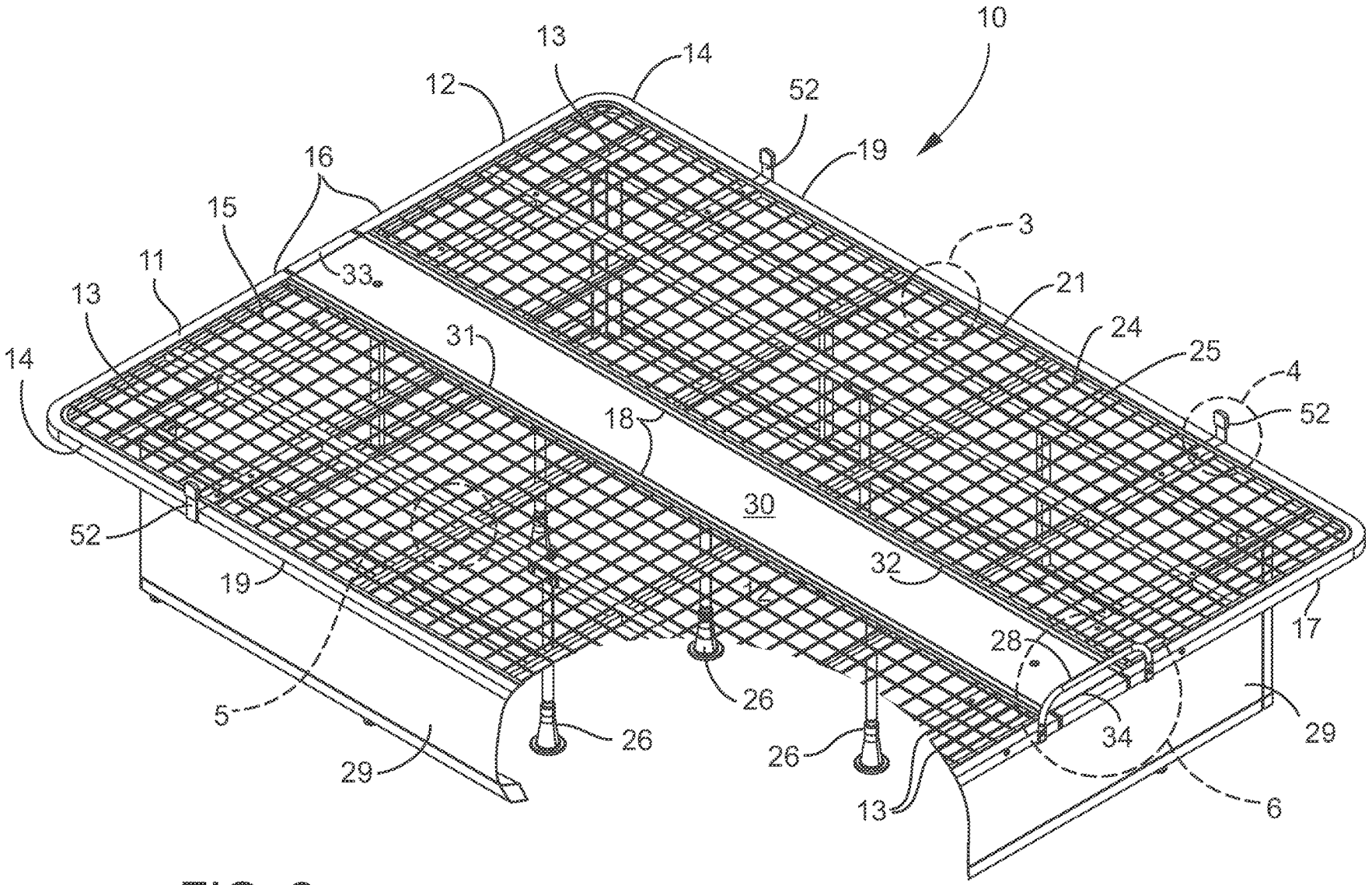
FIG. 2 is a fragmentary perspective view of the exemplary bed frame assembly.
Figure 3:
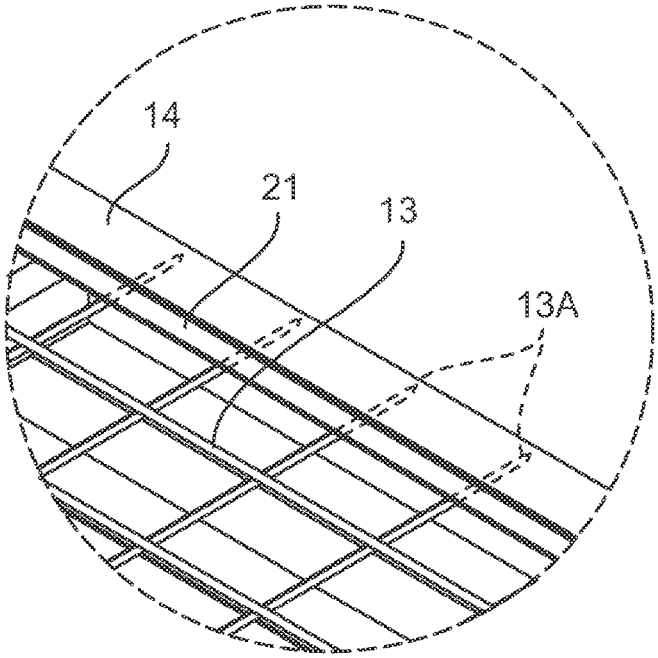
FIG. 3 is an enlarged fragmentary portion of the bed frame assembly within a dashed circled area indicated in FIG. 2 at reference numeral 3.
Figure 4:
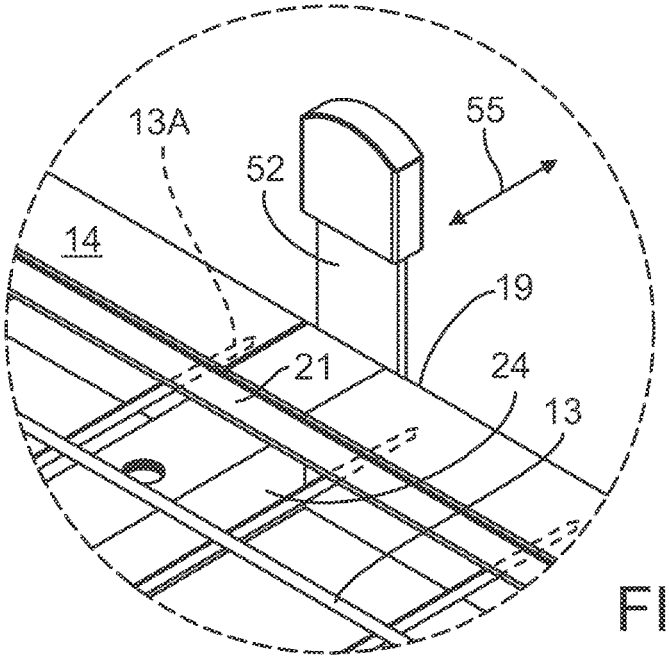
FIG. 4 is an enlarged fragmentary portion of the bed frame assembly within a dashed circled area indicated in FIG. 2 at reference numeral 4.
Figure 5:
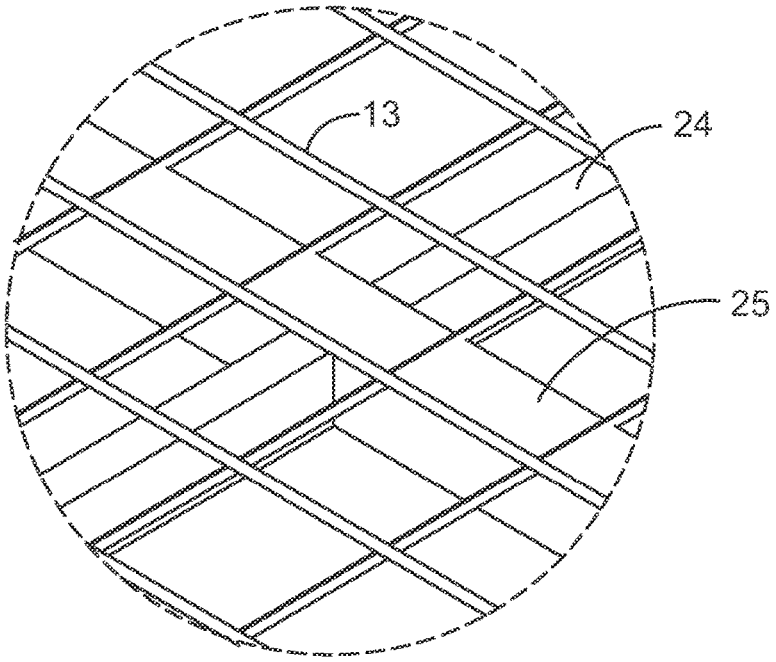
FIG. 5 is an enlarged fragmentary portion of the bed frame assembly within a dashed circled area indicated in FIG. 2 at reference numeral 5.
Figure 6:
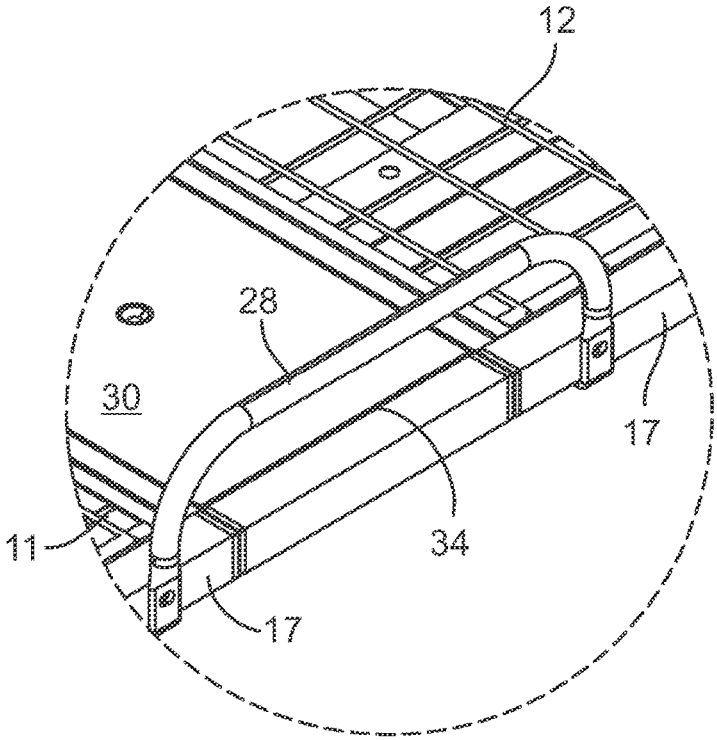
FIG. 6 is an enlarged fragmentary portion of the bed frame assembly within a dashed circled area indicated in FIG. 2 at reference numeral 6.

Referring to FIGS. 1-6, each rectangular bed platform 11, 12 comprises a metal wire mesh 13 surrounded by a perimeter square-pipe frame 14 and defining a horizontal top support surface 15, opposing lateral ends 16, 17 and opposing interior and exterior longitudinal sides 18, 19. Wire ends 13A of the metal wire mesh 13 may be welded or otherwise affixed directly to the perimeter square-pipe frame 14. See FIGS. 2, 3 and 4. A protective marginal cover 21 (FIGS. 3 and 4) is located adjacent the perimeter frame 14 and functions to extend over all wire ends 13A of mesh 13, and continuously along an entire width and length of each bed platform 11, 12. The exemplary protective cover 21 is likewise fabricated of metal, and extends inwardly over the wire ends 13A a distance of approximately 0.25-2.0 inches from perimeter frame 14. The exemplary bed platforms 11, 12 comprise respective underside strength-reinforcing lateral and longitudinal crossbars 24, 25, best shown in FIGS. 2 and 5, and a plurality of spaced apart vertical support legs 26. The support legs 26 are attached directly or indirectly to the crossbars 24, 25 (or other suitable frame structure), and are configured to locate the wire-mesh support surfaces 15 of bed platforms 11, 12 within substantially the same continuous plane above and parallel to the floor. When placed on the bed frame assembly 10, the mattress resides above the floor at a height of approximately 16 inches. As best shown in FIGS. 2 and 6, a mattress arrester 28 comprising an inverted U-shaped round pipe is detachably fastened to the bed platforms 11, 12 and functions to restrict migration of the mattress beyond the end of bed frame assembly 10. One or more metal apron panels 29 may surround the bed frame assembly 10 at opposite ends and sides.

In the present embodiment, the exemplary bed frame assembly 10 incorporates a removable center extension panel 30 configured to reside between the interior longitudinal sides 18 of the side-by-side bed platforms 11, 12 and coplanar with respective wire-mesh support surfaces 15. The exemplary extension panel 30 is fabricated of metal and comprises a solid continuous surface having opposing longitudinal sides 31, 32 and opposing lateral ends 33, 34. The opposing longitudinal sides 31, 32 of the extension panel 30 may be fastened directly to the interior longitudinal sides 18 of the side-by-side bed platforms 11, 12. When installed, the extension panel 30 functions to space-apart the bed platforms 11, 12 thereby increasing the width of the bed frame assembly 10. As shown in FIGS. 1 and 2, the opposing lateral ends 33, 34 of the center extension 30 substantially align with respective lateral ends 16, 17 of the bed platforms 11, 12.

FIGS. 7, 8 and 9 demonstrate installation of the present extension panel 30 in the exemplary bed frame assembly 10. The extension panel 30 enables ready and convenient conversion of the exemplary bed frame assembly 10 from a reduced-width configuration shown in FIG. 7 accommodating a full XL size mattress to an increased-width configuration shown in FIG. 9 accommodating a queen size mattress. From the full-size configuration of bed frame assembly 10, fasteners attaching the mattress arrester 28 to the perimeter frames 14 of bed platforms 11, 12 are removed from a first pair of fastener holes 41. With the mattress arrester 28 removed, the bed platforms 11, 12 are pulled apart as indicated by arrow 42. The exemplary bed platforms 11, 12 separate along spaced telescoping members 44 of the bed frame assembly 10 to form a longitudinal center opening 45 configured to receive the extension panel 30. The extension panel 30 is placed into the center opening 45 as indicated by direction arrow 46, and is secured to the bed frame assembly 10 using suitable fasteners. Once the extension panel 30 is installed, the mattress arrester 28 is reattached to the perimeter frames 14 of respective bed platforms 11, 12 using suitable fasteners through a second pair of fastener holes 51. The attached mattress arrester 28 further restricts inadvertent separation of the platforms 11, 12 in the enlarged queen size configuration of the bed frame assembly 10. When the extension panel 30 is removed, the bed platforms 11, 12 can return to their original position—combining together as shown in FIG. 7 to reduce the width of the bed frame assembly 10. Alternatively, or in addition, the exemplary bed frame assembly 10 may also comprise extendable upwardly-turned width adjustment bars 52 carried by respective lateral crossbars 24 of each bed platform 11, 12 and configured to selectively adjust (e.g., telescope) in a width direction of the bed frame assembly 10, as indicated by arrow 55 in FIG. 4.

Figure 10:
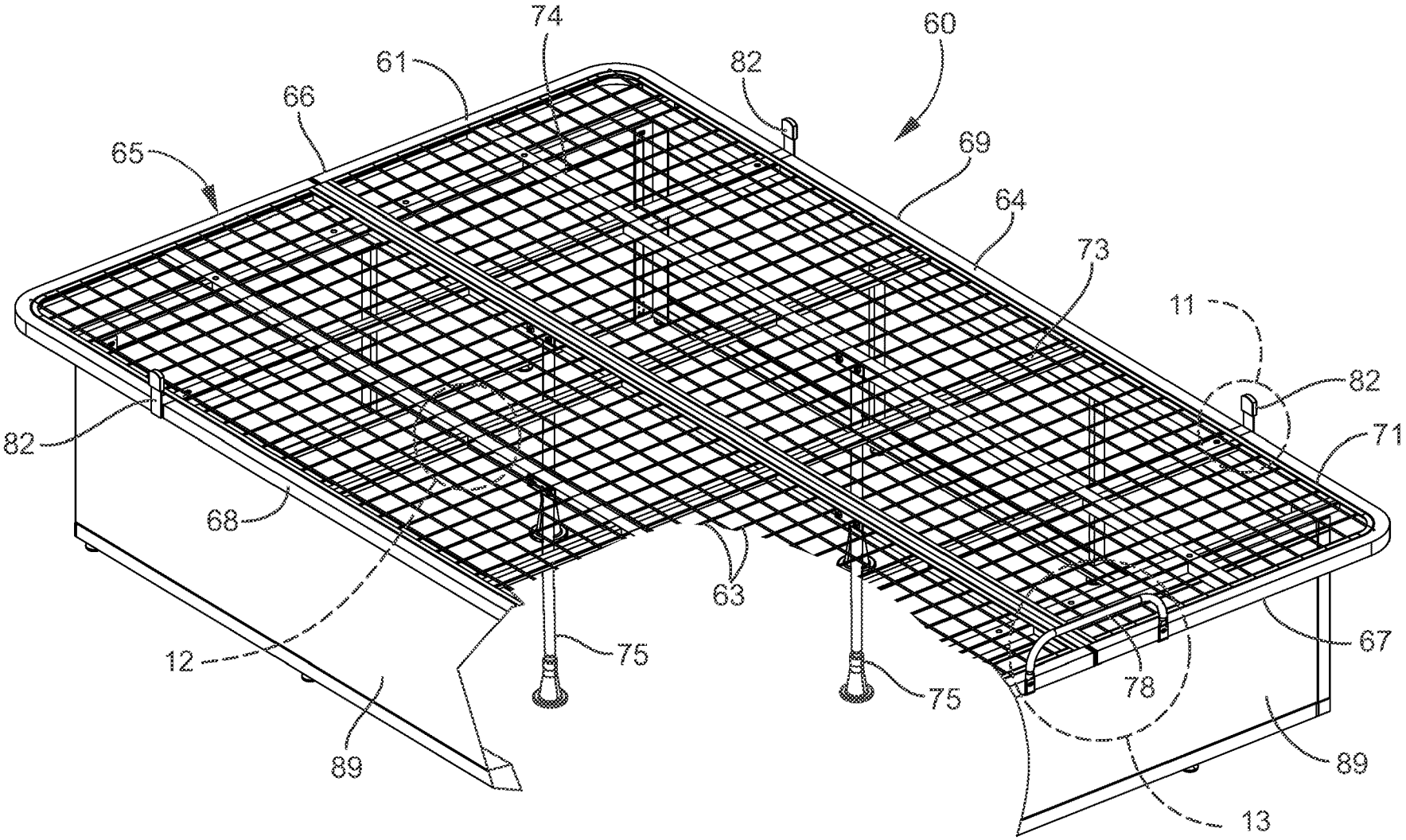
FIG. 10 is a perspective view of the present bed frame assembly according to an alternative exemplary embodiment of the disclosure.
Figure 12:
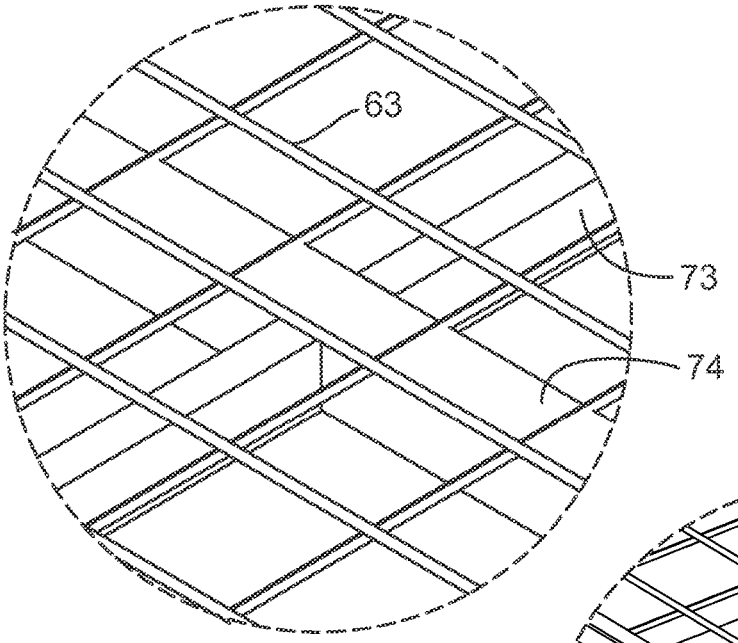
FIG. 12 is an enlarged fragmentary portion of the bed frame assembly within a dashed circled area indicated in FIG. 10 at reference numeral 12.
Figure 13:
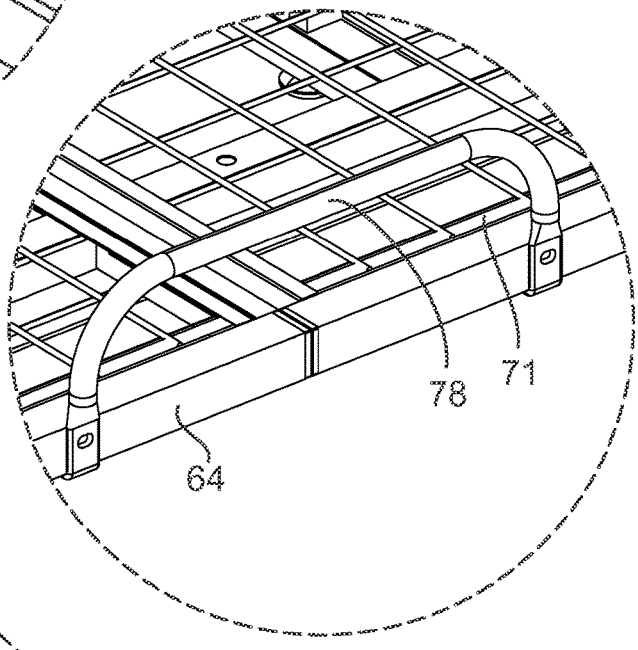
FIG. 13 is an enlarged fragmentary portion of the bed frame assembly within a dashed circled area indicated in FIG. 10 at reference numeral 13.
Figure 11:
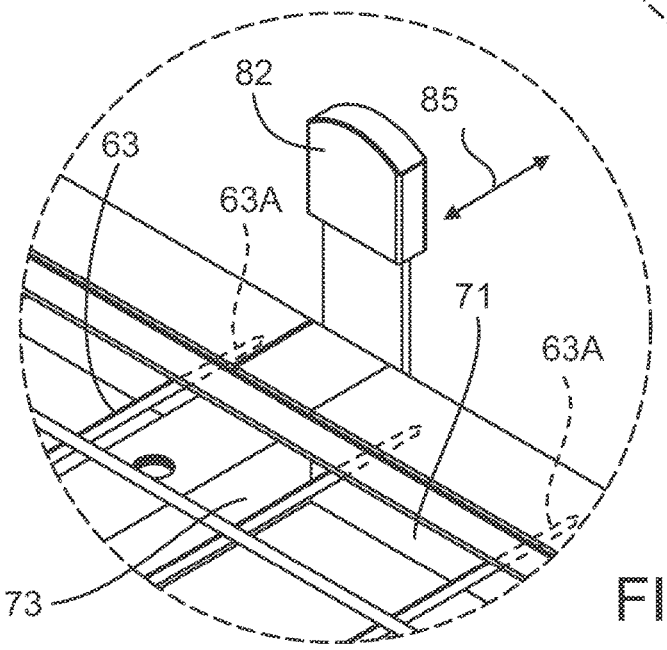
FIG. 11 is an enlarged fragmentary portion of the bed frame assembly within a dashed circled area indicated in FIG. 10 at reference numeral 11.

A further exemplary embodiment of the present bed frame assembly 60 is illustrated in FIGS. 10-13. In this embodiment, the bed frame assembly 60 incorporates a raised metal-wire mesh platform 61 having a fixed width configured to support a king size mattress. The metal wire mesh 63 is surrounded by a perimeter square-pipe frame 64 and defines a horizontal top support surface 65, opposing lateral ends 66, 67, and opposing interior and exterior longitudinal sides 68, 69. As previously discussed, wire ends 63A of the metal wire mesh 63 may be welded or otherwise affixed directly to the perimeter frame 64. See FIG. 11. A protective marginal cover 71 (FIGS. 11 and 13) is located adjacent the perimeter frame 64 and functions to extend over and conceal all wire ends 63A of mesh 63, and continuously along an entire width and length of the bed platform 61. The exemplary protective cover 71 is likewise fabricated of metal, and extends inwardly over the wire ends 63A a distance of approximately 1-3 inches. The exemplary bed platform 61 comprises underside strength-reinforcing lateral and longitudinal crossbars 73, 74, best shown in FIGS. 10 and 12, and a plurality of spaced apart vertical support legs 75. The support legs 75 are attached directly or indirectly to the crossbars 73, 74 (or other suitable frame structure), and are configured to locate the wire-mesh support surface 65 of bed platform 61 above and parallel to the floor. When placed on the bed frame assembly 60, the mattress resides above the floor at a height of approximately 16 inches. As best shown in FIGS. 10 and 13, a mattress arrester 78 comprising an inverted U-shaped round pipe is detachably fastened to the bed platform 61 and functions to restrict migration of the mattress beyond the end of bed frame assembly 60. The exemplary bed frame assembly 60 may also comprise extendable upwardly-turned width adjustment bars 82 carried by respective lateral crossbars 73 of the bed platform 61 and configured to selectively adjust (e.g., telescope) in a width direction of the bed frame assembly 60, as indicated by arrow 85 in FIG. 11. One or more metal apron panels 89 may surround the bed frame assembly 60 at opposite ends and sides.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A convertible bed frame assembly configured to support a mattress and having a width and a length, said bed frame assembly comprising:

first and second adjustable side-by-side rectangular bed platforms, each bed platform comprising a horizontal wire mesh support surface, opposing lateral ends, and opposing interior and exterior longitudinal sides, and said horizontal support surfaces of said side-by-side bed platforms residing in substantially the same plane, and surrounded by a perimeter frame such that when said side-by-side bed platforms are pulled apart and separated, said perimeter frame defines a longitudinal center opening extending from one end of said bed frame assembly to an opposite end of said bed frame assembly, and said center opening being formed by adjacent interior longitudinal sides of said side-by-side bed platforms and by lateral portions of said perimeter frame at opposing lateral ends of said side-by-side bed platforms, such that said longitudinal center opening is surrounded by said interior longitudinal sides of said side-by-side bed platforms and said lateral portions of said perimeter frame;

a single removable center extension comprising a solid continuous-surface panel having opposing longitudinal sides and opposing lateral ends, and said center extension being configured to insert into and occupy an entirety of said longitudinal center opening to reside between said interior longitudinal sides of said side-by-side bed platforms and between said lateral portions of said perimeter frame, and coplanar with respective horizontal support surfaces, such that:

(i) when installed, said center extension functions to separate said side-by-side bed platforms thereby increasing the width of said bed frame assembly; and (ii) when removed, said side-by-side bed platforms combine together to reduce the width of said bed frame assembly.

2. The bed frame assembly according to claim 1, and comprising a protective marginal cover adjacent said perimeter frame and extending inwardly over wire ends of said metal wire mesh.

3. The bed frame assembly according to claim 2, wherein said protective marginal cover extends continuously along an entire width and length of said bed frame assembly.

4. The bed frame assembly according to claim 3, wherein said protective marginal cover extends inwardly over the wire ends of said metal wire mesh a distance of approximately 1-3 inches.

5. The bed frame assembly according to claim 1, and comprising a plurality of vertical support legs located beneath each bed platform.

6. The bed frame assembly according to claim 1, wherein each bed platform comprises a plurality of underside strength-reinforcing lateral and longitudinal crossbars.

7. The bed frame assembly according to claim 6, and comprising a plurality of extendable width adjustment bars carried by respective lateral crossbars of each bed platform, and configured to selectively adjust in a width direction of said bed frame assembly.

8. The bed frame assembly according to claim 1, and comprising a mattress arrester located at one end of said bed frame assembly.

9. The bed frame assembly according to claim 8, wherein said mattress arrester is attached to each of said side-by-side bed platforms.

10. The bed frame assembly according to claim 1, wherein said side-by-side bed platforms are substantially identical.

* * * * *